US011739477B2

(12) United States Patent
Malmgren et al.

(10) Patent No.: US 11,739,477 B2
(45) Date of Patent: Aug. 29, 2023

(54) PRODUCTION OF MODIFIED PULP

(71) Applicant: SCA Forest Products AB, Sundsvall (SE)

(72) Inventors: Kent Malmgren, Sundsvall (SE); Thomas Nordqvist, Sundsvall (SE)

(73) Assignee: SCA FOREST PRODUCTS AB, Sundsvall (SE)

( * ) Notice: Subject to any disclaimer, the term of this patent is extended or adjusted under 35 U.S.C. 154(b) by 224 days.

(21) Appl. No.: 17/289,457

(22) PCT Filed: Oct. 29, 2019

(86) PCT No.: PCT/EP2019/079457
§ 371 (c)(1),
(2) Date: Apr. 28, 2021

(87) PCT Pub. No.: WO2020/089195
PCT Pub. Date: May 7, 2020

(65) Prior Publication Data

US 2022/0002945 A1 Jan. 6, 2022

(30) Foreign Application Priority Data

Oct. 29, 2018 (EP) ..... 18203118

(51) Int. Cl.
*D21H 11/20* (2006.01)
*D21C 9/00* (2006.01)
*D21D 1/02* (2006.01)

(52) U.S. Cl.
CPC ..... *D21C 9/005* (2013.01); *D21D 1/02* (2013.01); *D21H 11/20* (2013.01)

(58) Field of Classification Search
CPC ..... D21C 9/005; D21H 11/20; D21D 1/02
USPC ..... 162/157.6
See application file for complete search history.

(56) References Cited

U.S. PATENT DOCUMENTS

| | | | |
|---|---|---|---|
| 4,162,188 | A | 7/1979 | Nakamura et al. |
| 5,441,602 | A | 8/1995 | Harris et al. |
| 5,958,180 | A | 9/1999 | Hubbe et al. |
| 6,610,884 | B2 | 8/2003 | Gerle et al. |
| 2003/0029586 | A1 | 2/2003 | Jewell |
| 2003/0054167 | A1 | 3/2003 | Wang |
| 2016/0319482 | A1 | 11/2016 | Ben et al. |

FOREIGN PATENT DOCUMENTS

| | | | |
|---|---|---|---|
| EP | 1 122 237 | A1 | 8/2001 |
| EP | 3 150 762 | A1 | 4/2017 |
| WO | WO-97/32074 | A2 | 9/1997 |
| WO | WO-98/13545 | A1 | 4/1998 |
| WO | WO-03/016356 | A1 | 2/2003 |

OTHER PUBLICATIONS

Extended European Search Report issued in European patent application No. 18203118.7, dated Jan. 10, 2019.
Espy, Herbert H., et al., "The mechanism of wet-strength development by alkaline-curing amino polymer-epichlorohydrin resins," Tappi Journal, May 1998, pp. 133-137.
Winter, Lars et al., "Polyelectrolytes Adsorbed on the Surface of Cellulosic Materials," Journal of Colloid and Interface Science, Jun. 1986, vol. 111, No. 2, pp. 537-543.
Zakaria, S., "Development of wet-strength paper with dianhydride and diacid," Materials Chemistry and Physics, 2004, vol. 88, Issues 2-3, pp. 239-243.
De Nooy, A. E. J., et al., "On the use of stable organic nitroxyl radicals for the oxidation of primary and secondary alcohols," Synthesis, 1996, pp. 1153-1174.
Laine, J., et al., "Studies on topochemical modification of cellulosic fibres," Nordic Pulp and Paper Research Journal, 2000, vol. 15, No. 5, pp. 520-526.
de Melo, J. C. P., et al., "Maleic anhydride incorporated onto cellulose and thermodynamics of cation-exchange process at the solid/liquid interface," Colloids and Surfaces A: Physicochem. Eng. Aspects 2009, vol. 346, pp. 138-145.

*Primary Examiner* — Mark Halpern
(74) *Attorney, Agent, or Firm* — Faegre Drinker Biddle & Reath LLP

(57) ABSTRACT

A method for producing a modified lignocellulosic pulp having improved wet-strength properties and a modified lignocellulosic pulp obtainable by the method.

15 Claims, 4 Drawing Sheets

PRODUCTION OF MODIFIED PULP

CROSS-REFERENCE TO PRIOR APPLICATIONS

This application is a § 371 National Stage Application of PCT International Application No. PCT/EP2019/079457 filed Oct. 29, 2019, which claims priority to European Patent Application No. 18203118.7 filed on Oct. 29, 2018, both of which are incorporated herein in their entirety.

The present invention relates to a method for producing a modified lignocellulosic pulp having improved wet-strength properties and a modified lignocellulosic pulp obtainable by the method.

Paper products including tissue paper, board and packaging products are manufactured from lignocellulosic material. The manufacture of such products involves forming, typically in a pulping process in a pulp mill, of a pulp from a lignocellulosic biomass material wherein the pulp comprises an aqueous suspension of cellulose fibers and producing, typically in a paper process in a paper mill, a web of fibers on a paper machine which is then pressed and dried. The paper process may include a conventional beating stage preceding the paper machine.

An important aspect for the quality of many paper products is the wet-strength of the paper product. A pulp providing high wet-strength would especially be interesting for the production of tissue paper but also of great value for the production of other paper grades requiring a high wet-strength.

At present, the most common method to achieve wet-strength is the addition of wet-strength resins to wet pulp during the paper making process. The most common wet-strength resin is polyaminoamido-epichlorohydrin (PAE). This resin consists of a condensation polymer typically between adipic acid and diethylenetriamine which has been reacted with epichlorohydrin. The structure, use and chemical reactions of PAE are described, e.g. in Espy, H. H. and Rave, T. W. "The mechanism of wet-strength development by alkaline-curing amino polymer-epichlorohydrin resins." (Tappi Journal 71 (1988), 133-137) and in Dunlop-Jones, N. in Paper Chemistry, Blackie & Sons Ltd., Glasgow and London (1991) p. 76-96. In order to obtain a sufficient wet-strength of paper products, however, wet-strength resins such as PAE have to be added in relatively high amounts making the manufacture of the paper product expensive.

U.S. Pat. No. 5,958,180 describes processes for increasing the strength of cellulosic fibers by adding a carboxylic acid cyclic anhydride to relatively dry cellulosic fibers and taking the fibers and agent in contact therewith at an elevated temperature for a time sufficient to substantially increase the potential of fibers to form strong interfiber bonds. Treatment of dried fluffed kraft pulp with maleic anhydride powder and a subsequent heating leads to a moderate increase in the negative surface charge from 1.70 μEq/g to 3.00 μEq/g (1.70 μmol/g to 3.00 μmol/g). While a certain increase in dry strength properties of paper products manufactured from the modified pulp are shown, no effects on the wet-strength have been demonstrated.

Thus, there is a need to provide modified pulp which is suitable for producing a paper product with high wet-strength while avoiding the need of adding wet-strength resins in high amounts.

SUMMARY OF THE INVENTION

A first aspect of the present invention relates to a method for producing a modified lignocellulosic pulp comprising the steps:

(i) providing a dry lignocellulosic pulp, particularly a pulp having a dryness of at least about 85 weight-%; and (ii) adding a dicarboxylic acid anhydride, particularly with a molecular weight of 220 g/mol or less, to the dry pulp in an amount and under conditions to obtain a modified pulp having a negative surface charge of at least about 8 μmol/g based on the dry pulp weight.

Further, the method may comprise the step: (iii) beating the pulp from step (ii).

The present inventors have found that pulp modified by addition of a dicarboxylic acid anhydride surprisingly shows a substantial increase in the wet-strength compared to an unmodified pulp. Thus, the modified pulp is particularly suitable for high wet-strength applications. The increase in the wet-strength is particularly notable when the pulp from step (ii) is subjected to beating thereby activating its wet-strength properties.

A second aspect of the present invention relates to a modified pulp obtainable by the method as described above. In particular, the pulp is modified by addition of a dicarboxylic acid anhydride with a molecular weight of 220 g/mol or less and characterized by a negative surface charge of at least about 8 μmol/g or at least about 10 μmol/g based on the dry pulp weight and optionally a ratio between negative surface charge and negative total charge from about 15% to about 40%.

A third aspect of the present invention is a fiber-based product, particularly a paper product, obtainable from a modified pulp as described above. In particular, the fiber-based product of the invention has an increased wet-strength, e.g. an increased wet tensile strength index, compared to a paper product produced from an unmodified pulp even without addition of a wet-strength resin.

A fourth aspect of the present invention relates to the use of the modified lignocellulosic pulp as described above for the manufacture of a fiber-based product such as a paper product, particularly for the manufacture of a wet-strength paper product including board and packaging products, more particularly for the manufacture of a tissue paper.

A fifth aspect of the present invention relates to the use of a dicarboxylic acid anhydride for increasing the wet-strength of lignocellulosic pulp and of a fiber-based product produced from said pulp.

DETAILED DESCRIPTION

The term "lignocellulosic pulp" herein refers to a pulp from a lignocellulosic biomass material. Lignocellulosic pulp is obtained by processing of a plant material.

The "wet-strength" of a lignocellulosic pulp herein refers to the wet-strength of a sheet or paper product formed of said pulp. Wet strength is basically a measure of how well the web of fibers holds the sheet together when the paper is wet. Wet strength values and ranges herein refer to standardized ISO procedures of sheet forming and wet strength measuring (see "Methods" below). Typically, steps of disintegrating, beating, sheet forming, and/or heating are preceding or included in the wet strength measuring of a pulp.

The invention relates to a method for producing a modified lignocellulosic pulp. In step (i) a dry pulp is provided, particularly a dry pulp having a dryness of at least about 85 weight-%, at least 88 weight-% or at least about 90 weight-%. The dryness of the pulp is expressed by the weight percentage of pulp dry mass based on the total weight of the pulp. Pulp having the required dryness may be obtained from wet pulp including never-dried wet pulp or dried and resuspended pulp by removal of water, e.g. by heating, until the desired dryness is achieved.

In particular embodiments the step (i) of providing a dry pulp comprises drying the pulp to form a substantially dry pulp, particularly drying the pulp to a dryness of at least about 85 weight-%, at least 88 weight-% or at least about 90 weight-%.

In step (ii) a dicarboxylic acid anhydride, particularly a dicarboxylic acid anhydride having a molecular weight of 220 g/mol or less, is added to the dry pulp in an amount and under conditions to obtain the modified pulp. The dicarboxylic acid anhydride reacts with hydroxyl groups of cellulose in the pulp whereby an ester linkage and a carboxylic acid group are formed. The carboxylic acid group provides an additional negative charge to a cellulosic fiber as it is deprotonated in water at a neutral or alkaline pH.

In step (iii) the pulp from step (ii) is subjected to beating. The term "beating" herein refers to any physical treatment of lignocellulosic pulp wherein the area of contact between individual fibers is increased by increasing their surface through fibrillation and by making them more flexible. In certain embodiments, the beating is carried out in a paper mill.

In certain embodiments, the Schopper Riegler degree of the pulp is increased by at least 2 degree SR, by at least 3° SR or by at least 5° SR in step (iii). Further, in step (iii) the Schopper Riegler degree of the pulp may be increased by up to 70° SR, by up to 60° SR or by up to 50° SR. The Schopper Riegler (SR) beating degree may be measured according to ISO 5267-1.

In certain embodiments, the pulp has a Schopper Riegler beating degree of at least about 16° SR, or at least about 19° SR after step (iii). Further, the Schopper Riegler beating degree may be up to about 70 or up to about 85° SR after step (iii).

The present inventors have found that adding a dicarboxylic acid anhydride such as maleic acid anhydride (sometimes also referred to as "maleic anhydride") to dry pulp may provide a modified pulp which is suitable for producing a paper product with high wet strength when the dicarboxylic acid anhydride is added in an amount and under conditions to obtain a modified pulp having a negative surface charge of at least about 8 μmol/g based on the dry pulp weight. In particular embodiments, the modified pulp has a negative surface charge of at least about 10 μmol/g, at least about 12 μmol/g, at least about 15 μmol/g or at least about 20 μmol/g and up to about 40 μmol/g based on the dry pulp weight.

By means of the treatment with dicarboxylic acid anhydride the negative surface charge of the modified pulp is increased compared to the negative surface charge of an unmodified pulp. In particular embodiments, the negative surface charge is increased by a factor of at least about 2, at least about 2.5, at least about 4 or at least about 7 and up to about 15.

In particular embodiments, treatment with dicarboxylic acid anhydride is carried out under conditions wherein the ratio between the negative surface charge and the negative total charge of the pulp is increased compared to an unmodified reference pulp. For example, a ratio between the negative surface charge and the negative total charge (i.e. a relative negative surface charge) from about 15% to about 40%, e.g. of about 20% to about 40%, may be obtained.

The determination of the negative surface charge of modified pulp or unmodified pulp is carried out on an unbeaten pulp as described herein in the section "Methods" by making polyelectrolyte adsorption isotherms with an appropriate high-molecular weight cationic polymer such as poly(diallyldimethylammonium) chloride that is ultrafiltrated using a filter with cut-off of 300000 Da in order to remove the low-molecular weight fraction and titration with an anionic polyelectrolyte, such as potassium polyvinyl sulfate (KPVS), in an appropriate equipment, e.g. a particle charge detector, in order to detect the zero-point and to calculate the fiber surface charge. The measured negative surface charge is a permanent charge of the unbeaten pulp.

The determination of the negative total charge of a modified pulp or unmodified pulp is carried out on an unbeaten pulp as described herein in the section "Methods" by making polyelectrolyte adsorption isotherms with an appropriate lower-molecular weight cationic polymer, such as poly(hexadimethrine) bromide, with a molecular weight of about 4,000-6,000 g/mol, e.g. a molecular weight of about 5,000 g/mol, and subsequent titration with an anionic polyelectrolyte, such as KPVS. Again, detection of the zero-point and calculation of the total negative fiber charge may be performed in an appropriate equipment, e.g. a particle charge detector. The measured negative total charge is a permanent charge of the unbeaten pulp.

The relative negative surface charge, i.e. the ratio between the negative surface charge and the negative total charge of the fibers of the pulp may be calculated as follows:

$$Z_r=(Z_s/Z_t)\cdot 100$$

wherein $Z_r$ is the relative negative surface charge in percent, $Z_s$ is the measured negative surface charge, and $Z_t$ is the measured negative total charge.

By means of the treatment with dicarboxylic acid anhydride the relative negative surface charge may be increased compared to the relative negative surface charge of an unmodified pulp. In particular embodiments, the relative negative surface charge is increased by a factor of at least 1.5, at least about 2 or at least about 4 and up to about 10.

Treatment of lignocellulosic pulp with dicarboxylic acid anhydride provides a modified pulp having increased wet-strength properties compared to an unmodified reference pulp, i.e. a pulp having the same properties but without modification. The increased wet-strength properties can be released or activated, e.g. by beating the pulp. "Beating" herein includes mechanical processing of the pulp e.g. by means of conventional equipment for beating, refining, and/or grinding the pulp, such as disc refiners, conical refiners and other equipment for beating/refining/grinding the pulp to affect its fiber characteristics.

A modified pulp having the above-indicated features can be obtained by adding a dicarboxylic acid anhydride to the dry pulp in a suitable amount and under suitable conditions. For example, the dicarboxylic acid anhydride may be added e.g. in an amount of between about 1 kg to about 55 kg, between about 2 kg to about 50 kg, between about 5 kg to about 45 kg, between about 10 kg to about 40 kg, between about 5 kg to about 30 kg, between about 10 kg to about 20 kg, between about 12 kg to about 30 kg, between about 10 kg to about 55 kg, between about 12 kg to about 55 kg and between 15 kg to about 50 kg or between about 20 kg to about 40 kg per ton pulp based on the dry pulp weight.

In certain embodiments, the dicarboxylic acid anhydride may be a cyclic acid anhydride having a molecular weight of 220 g/mol or less selected from the group of maleic anhydride; succinic anhydride; citraconic anhydride; itaconic anhydride; 2,3-dimethylmaleic anhydride; ethylsuccinic anhydride; 2,2-dimethylsuccinic anhydride; phthalic anhydride; quinolinic anhydride; diacetyl-tartaric anhydride; tetramethylsuccinic anhydride; diglycolic anhydride; and glutaric anhydride. In particular embodiments, the dicarboxylic acid anhydride has a boiling point of 100° C. or more at atmospheric pressure. In a very particular embodiment, the dicarboxylic acid anhydride is maleic acid anhydride.

In principle, the pulp to be modified according to the present invention may be any type of lignocellulosic pulp such as virgin pulp, recycled pulp or any combination thereof.

In particular embodiments, the pulp provided in step (i) is an unbeaten pulp, e.g. an unbeaten pulp from a pulp mill such as a never-dried pulp, e.g. a never-dried bleached pulp, for example a kraft pulp, or a sulfite pulp and particularly selected from a softwood pulp, or a hardwood pulp such as a eucalyptus pulp. For example, the pulp may be a northern bleached softwood kraft (NBSK) pulp or a bleached eucalyptus kraft (BEK) pulp.

A typical unmodified NBSK pulp was found to have a negative surface charge of about 4 μmol/g and a relative negative surface charge of about 15%. The wet tensile strength index was determined to be 0 kNm/kg. By means of treatment with maleic acid anhydride the negative surface charge could be increased to about 20 μmol/g or more and up to 40 μmol/g or more, i.e. an increase of a factor by at least 5 and up to 10 or more. The modified NBSK pulp was found to have a considerable wet-strength, as demonstrated by a wet tensile strength index of about 5 kNm/kg or more and up to about 20 kNm/kg.

An unmodified BEK pulp was found to have a negative surface charge of about 3 μmol/g and a relative negative surface charge of about 5%. The wet tensile strength index was determined as being 0 kNm/kg. By means of treatment with maleic acid anhydride the negative surface charge could be increased to about 10 μmol/g or more, i.e. an increase by a factor of about 3 or more. The relative negative surface charge was increased to about 15% or more, which is an increase by a factor of at least about 3. The wet tensile strength index was determined as being about 5 kNm/kg or more.

The present inventors have also found that an efficient reaction between the cellulose fibers of the pulp and the dicarboxylic acid anhydride may take place at temperatures of about 100° C. or less. Thus, in certain embodiments, the pulp is kept at a temperature of about 100° C. or less, e.g. at a temperature from about 20° C. to about 80° C., from about 40° C. to about 80° C. or from about 50° C. to about 70° C. during the time period when a reaction between the pulp and the dicarboxylic acid anhydride takes place. Further, the temperature of the pulp may be kept substantially constant or decreasing following dicarboxylic acid anhydride addition.

In specific embodiments of the present invention, the dicarboxylic acid anhydride is added to the pulp in a gaseous or liquid distribution medium, by means of which the dicarboxylic acid anhydride is distributed onto the pulp fibers, particularly a gaseous or liquid distribution medium in which the dicarboxylic acid anhydride is homogeneously distributed.

In a specific embodiment, the distribution medium is a gaseous distribution medium, particularly hot air comprising the dicarboxylic acid anhydride in gaseous form. This may be provided by evaporating the dicarboxylic acid anhydride through contact with hot air. Subsequently, a first stream of hot air comprising gaseous dicarboxylic acid anhydride may be passed over the pulp to be treated, such that the dicarboxylic acid anhydride condenses on the surface of the pulp fibers. The temperature of the pulp fibers is substantially lower than the temperature of the first stream of hot air.

Preferably, the pulp is provided in and carried by a second stream of air having a substantially lower temperature than the first stream of hot air. The first stream of hot air containing gaseous dicarboxylic acid anhydride may in such embodiments be added to the second stream of air containing the pulp fibers, such that the dicarboxylic acid anhydride condenses on the surface of the pulp fibers. The addition point could e.g. be in the end section of a flash dryer in a pulp mill.

For example, the temperature of the first stream of hot air may be about 70° C. to about 300° C. If present, the temperature of the second stream of air may be about 40° C. to about 100° C.

When using a gaseous distribution medium, the pulp is particularly provided as a disintegrated pulp, e.g. as a fluffed pulp, comminution pulp, and/or flash dried pulp. The pulp may for example be disintegrated using conventional disintegrator means, such as a hammer mill, a pin mill, a disc refiner, or a shredder.

The pulp, preferably disintegrated pulp, e.g. fluff pulp, but alternatively sheet pulp, may be provided on a gas-permeable support, e.g. a mesh, and a stream of hot air comprising the dicarboxylic acid anhydride is passed over the pulp through the permeable support.

In specific embodiments, the pulp is not heated after being contacted with a gaseous distribution medium containing the dicarboxylic acid anhydride during the time period wherein the reaction of the dicarboxylic acid anhydride and the cellulosic fiber takes place.

In a further specific embodiment of the invention, the distribution medium is a liquid distribution medium, particularly an organic solvent, more particularly an organic solvent with a boiling point of at least about 80° C., of at least about 100° C. or of at least about 120° C. under atmospheric pressure wherein the distribution medium comprises the dicarboxylic acid anhydride in suspended or particularly in dissolved form.

More particularly, the organic solvent is aprotic, i.e. substantially free from hydroxyl- and aminofunctions, in order to avoid reactions with the dicarboxylic acid anhydride. The organic solvent is preferably a non-swelling organic solvent, i.e. a solvent which does not swell cellulosic fibers.

In a particular embodiment, the organic solvent is triacetin. In another particular embodiment, the organic solvent is acetone.

When the distribution medium is an organic solvent, in particular a high boiling solvent, it may comprise at least about 20 weight-%, at least about 30 weight-% or at least about 40 weight-% and up to about 80 weight-%, up to about 70 weight-% or up to about 60 weight-% dicarboxylic acid anhydride based on the total weight of the distribution medium.

When using a liquid distribution medium, the pulp may be provided in form of a sheet, e.g. a sheet having a density of 1100 kg/m$^3$ or less.

In this embodiment, the pulp is kept e.g. at an elevated temperature of about 40° C. up to the boiling point of the organic solvent, e.g. of about 45° C. to about 70° C., or of about 50° C. to about 70° C. to about 100° C., after being contacted with the distribution medium.

In specific embodiments, the temperature of the lignocellulosic pulp is kept at 100° C. or lower, in particular 70° C.

or lower, during the time period when the reaction of the dicarboxylic acid anhydride with the lignocellulosic fibers take place.

In certain embodiments, the reaction of the pulp with a dicarboxylic acid anhydride is carried out under conditions which prohibit the access of atmospheric moisture, e.g. under a dry atmosphere relative humidity about 20% or less or about 10% or less and/or in a closed container limiting an access of atmospheric moisture to the pulp.

According to the method of the present invention, a fiber-based product, such as a paper product, may be produced from the modified pulp that has an increased wet-strength, e.g. an increased wet tensile strength index, compared to a paper product produced from an unmodified pulp. This increased wet-strength is also observed if no wet-strength resin is added to the pulp. Under these conditions, a paper product produced from an unmodified pulp was found to have no wet-strength at all whereas a substantial wet-strength was observed in a paper product produced from a modified pulp.

The method of the present invention may further comprise conventional treatment steps before and/or after modifying the pulp as described above.

The method may further comprise a step of activating the increased wet-strength characteristics provided by the reaction with dicarboxylic acid anhydride, for example by beating the modified pulp in a paper mill corresponding to at least 1000 revolutions, e.g. about 4000 revolutions, in a laboratory PFI mill, wherein the Schopper-Riegler (SR) beating degree may be increased by about 2-3° SR. In particular embodiments, the beating procedure is carried out according to ISO 5264-2.

Further, the method may comprise a subsequent step of adding a wet-strength resin to the modified pulp in order to obtain a further increase in wet-strength. The wet-strength resin may e.g. be selected from the group consisting of polyaminoamido-epichlorohydrin (PAE), urea-formaldehyde (UF), melamin-formaldehyde (MF), glyoxylated polyacrylamide (g-PAM) and any combination thereof. In a particular advantageous embodiment, the wet-strength resin is PAE which may be added in an amount of up to about 5 kg/ton pulp. According to the present invention, the amount of added wet-strength resin may be considerably reduced compared to an unmodified pulp since the modification provides substantial added wet-strength increase. Thus, the costs for making paper can be substantially reduced.

The dicarboxylic acid anhydride addition in accordance with the present invention may also be useful together with higher amounts of added PAE, in order to further increase the wet-strength in applications requiring an especially high wet-strength. Thus, the wet-strength resin PAE may be added in an amount of up to about 15, or in an amount of up to about 20 kg/ton pulp.

The method of the present invention may be carried out in a continuous process, e.g. comprising continuously adding the dicarboxylic acid anhydride to the pulp.

In a particular embodiment, the method of the present invention comprises the steps of:

providing a pulp having a dryness of at least about 85%;

continuously adding a predefined amount of a dicarboxylic acid anhydride to the dried pulp using a distribution medium for homogeneous distribution;

optionally maintaining the process temperature substantially constant or decreasing following the dicarboxylic acid anhydride addition;

measuring, online or intermittently, e.g. at regular or irregular time intervals, the surface charge of the pulp; and adjusting, if needed, the amount of dicarboxylic acid anhydride to be added to the pulp based on the measured surface charge, so as to achieve a desired negative surface charge of the modified pulp of at least about 8 μmol/g.

The method of the present invention may further comprise the step of producing a fiber-based product, e.g. a paper product, from the modified pulp. The term "fiber-based product" includes products comprising lignocellulosic fibers including paper products and non-woven products. The term "paper product" is intended to include paper board and packaging products such as liner/container/card board, but more particularly tissue paper. In particular embodiments, the method comprises the manufacture of a tissue paper for high wet-strength applications such as household or hygiene paper, e.g. kitchen towels or hygiene paper towels.

The second aspect of the present invention relates to a modified lignocellulosic pulp obtainable by a method as described above. The pulp is particularly suitable for high wet-strength applications and characterized by dicarboxylic acid anhydride addition and characterized by an increased negative surface charge compared to an unmodified pulp wherein the negative surface charge is at least about 8 μmol/g or at least about 10 μmol/g based on the dry pulp weight. Optionally, the pulp is characterized by further parameters such as a relative negative surface charge from about 15% to about 40%.

Further, the pulp is characterized by providing an increased wet-strength to a fiber-based product, e.g. a paper product produced therefrom as compared to an unmodified reference pulp, i.e. a pulp having the same properties but without modification. The increased wet-strength of the modified pulp may be activated by beating the pulp. A degree of beating corresponding to at least about 1000 revolutions in a PFI mill is preferred. In contrast thereto, beating of unmodified reference pulp does not provide an increase in wet-strength. In certain embodiments, the pulp is characterized by a Schopper-Riegler beating degree of at least about 16° SR, or at least about 19° SR. Further, the increased wet-strength of modified pulp is observed if no wet-strength resin has been added to the pulp for the production of the fiber-based, e.g. paper product. For example, the pulp is capable of providing a wet tensile strength index after beating and without added wet-strength resin of at least about 5 kNm/kg or at least about 10 kNm/kg when measured according to ISO 1924-3.

In a particular embodiment, the pulp is a bleached softwood kraft pulp, e.g. a northern bleached softwood kraft (NBSK) pulp, and the Schopper-Riegler (SR) beating degree is at least about 16° SR, more particularly at least about 19° SR.

As described above, the pulp may be selected from any type of a suitable lignocellulosic pulp, e.g. a kraft pulp or a sulfite pulp, wherein the pulp may be selected from a softwood pulp, e.g. a NBSK pulp, or a hardwood pulp, e.g. a eucalyptus pulp. In a particular embodiment, the pulp is a NBSK pulp, e.g. with a negative surface charge of at least about 10 μmol/g, or of at least about 20 μmol/g and preferably a relative negative surface charge of at least about 18% or a eucalyptus kraft pulp, e.g. with a negative surface charge of at least about 10 μmol/g and preferably a relative negative surface charge of at least about 15%.

The third aspect of the present invention relates to a fiber-based product, particularly a paper product, obtainable from a modified lignocellulosic pulp as described above. The paper product may be a tissue paper, particularly for high wet-strength applications as described above. The product is characterized by having an increased wet-strength, e.g. as described above compared to a product manufactured from an unmodified reference pulp.

The fourth aspect of the present invention relates to the use of the modified lignocellulosic pulp for the manufacture of a fiber-based product, such as a paper product, particularly for the manufacture of a wet strength paper product, more particularly for the manufacture of a tissue paper.

The fifth aspect of the invention relates to the use of dicarboxylic acid anhydride for increasing the wet strength of lignocellulosic pulp and of a fiber-based product such as a paper product produced from said pulp.

Further, the present invention is described by the following embodiments as part of the specification:

1) A method for producing a modified lignocellulosic pulp, comprising the steps:
   (i) providing a dry lignocellulosic pulp, particularly a pulp having a dryness of at least about 85 weight-%;
   (ii) adding a dicarboxylic acid anhydride, particularly with a molecular weight of 220 g/mol or less, to the dry pulp in an amount and under conditions to obtain a modified pulp having a negative surface charge of at least about 8 μmol/g based on the dry pulp weight, and
   (iii) beating the pulp from step (ii).

2) The method of embodiment 1 wherein in step (iii) the Schopper Riegler degree of the pulp is increased by at least 2° SR, by at least 3° SR or by at least 5° SR.

3) The method of embodiment 2 wherein in step (iii) the Schopper Riegler degree of the pulp is increased by up to 70° SR, by up to 60° SR or by up to 50° SR.

4) The method of any one of the previous embodiments wherein the pulp has a Schopper Riegler degree of at least about 16° SR, or at least about 19° SR after step (iii).

5) The method of any one of the previous embodiments wherein a modified pulp having a negative surface charge of at least about 10 μmol/g, at least about 12 μmol/g, at least about 15 μmol/g or at least about 20 μmol/g and up to about 40 μmol/g based on the dry pulp weight is obtained.

6) The method of any one of the previous embodiments wherein a modified pulp having increased wet-strength properties compared to an unmodified reference pulp, particularly an increased wet tensile strength index, is obtained.

7) The method of embodiment 6 wherein a modified pulp is obtained which has a wet tensile strength index of at least about 5 kNm/kg after beating when measured according to ISO 1924-3, without addition of a wet-strength resin.

8) The method of any one of the previous embodiments, wherein the dicarboxylic acid anhydride is added in an amount of between about 1 kg to about 55 kg, between about 2 kg to about 50 kg, between about 5 kg to about 45 kg, between about 10 kg to about 40 kg, between about 5 kg to about 30 kg, between about 10 kg to about 20 kg, between about 12 kg to about 30 kg, between 10 kg to about 55 kg, between about 12 kg to about 55 kg, between about 15 kg to about 50 kg or between about 20 kg to about 40 kg per ton pulp based on the dry pulp weight.

9) The method of any one of the previous embodiments wherein a modified pulp is obtained which has an increased negative surface charge compared to the unmodified pulp wherein the negative surface charge is increased by a factor of at least about 2, at least about 2.5, at least about 4, or at least about 7 and up to about 15.

10) The method of any one of the previous embodiments wherein a modified pulp having a relative negative surface charge from about 15% to about 40%, e.g. of about 20% to about 40%, is obtained.

11) The method of any one of the previous embodiments wherein said pulp is an unbeaten pulp, particularly selected from a kraft pulp, or a sulfite pulp, e.g. a softwood pulp, a hardwood pulp or a eucalyptus pulp.

12) The method of embodiment 11 wherein the pulp is a northern bleached softwood kraft (NBSK) pulp or a eucalyptus kraft pulp, particularly an NBSK pulp.

13) The method of any one of previous embodiments, wherein the dicarboxylic acid anhydride is a cyclic acid anhydride selected from the group of maleic anhydride; succinic anhydride; citraconic anhydride; itaconic anhydride; 2,3-dimethylmaleic anhydride; ethylsuccinic anhydride; 2,2 dimethylsuccinic anhydride; phthalic anhydride; quinolinic anhydride; diacetyl-tartaric anhydride; tetramethylsuccinic anhydride; diglycolic anhydride; and glutaric anhydride.

14) The method of any one of the previous embodiments, wherein the dicarboxylic acid anhydride has a boiling point of 100° C. or more at atmospheric pressure.

15) The method of embodiment 13 or 14, wherein the dicarboxylic acid anhydride is maleic acid anhydride.

16) The method of one of the previous embodiments, wherein the pulp is kept at a temperature of about 100° C. or less, from about 40° C. to about 80° C., or from about 50° C. to about 70° C. during the time period when a reaction between the pulp and the dicarboxylic acid anhydride takes place.

17) The method of any one of the previous embodiments, wherein the dicarboxylic acid anhydride is added to the pulp in a gaseous or liquid distribution medium, in which the dicarboxylic acid anhydride is homogenously distributed.

18) The method of embodiment 17 wherein the distribution medium is a gaseous distribution medium, particularly hot air comprising the dicarboxylic acid anhydride in gaseous form.

19) The method of embodiment 18 wherein the pulp is provided as disintegrated pulp, e.g. as fluffed pulp and/or flash-dried pulp.

20) The method of any one of embodiments 17-19 wherein the pulp is not heated during the time period wherein the reaction between the lignocellulosic fibers of the pulp and the dicarboxylic acid anhydride takes place.

21) The method of any one of embodiments 17-20, wherein the dicarboxylic acid anhydride is evaporated through contact with hot air; and a first stream of hot air comprising gaseous dicarboxylic acid anhydride is passed over the pulp optionally provided in a second stream of air having a substantially lower temperature than the first stream of hot air, such that the dicarboxylic acid anhydride condenses onto the surface of the pulp fibers.

22) The method of embodiment 17 wherein the distribution medium is a liquid distribution medium, particularly an aprotic organic solvent with a boiling point of at least about 80° C., of at least about 100° C. or of at least about 120° C. under atmospheric pressure comprising the dicarboxylic acid anhydride in dissolved form.

23) The method of embodiment 22 wherein the organic solvent is a non-swelling organic solvent.

24) The method of embodiment 21 or 22 wherein the organic solvent is triacetin.

25) The method of any one of embodiments 22-24 wherein the distribution medium comprises at least about 20 weight-%, at least about 30 weight-% or at least about 40 weight-% and up to about 80 weight-%, up to about 70 weight-% or up to about 60 weight-% dicarboxylic acid anhydride based on the total weight of the distribution medium.

26) The method of any one of embodiments 22-25 wherein the pulp is provided in form of a sheet.

27) The method of any one of embodiments 22-26 wherein the pulp is kept at a temperature of about 20° C. up to about 80° C., of about 40° C. up to about 80° C., or of about 50° C. to about 70° C. after being contacted with the distribution medium wherein the reaction between the lignocellulosic fibers of the pulp and the dicarboxylic acid anhydride takes place.

28) The method of any one of the previous embodiments wherein the reaction between the lignocellulosic fibers of the pulp and the dicarboxylic acid anhydride is carried out under conditions which prohibit the access of atmospheric moisture.

29) The method of any previous embodiments, wherein the modified pulp is beaten in a paper mill.

30) The method of any previous embodiments, further comprising the subsequent step of adding a wet-strength resin to the modified pulp to obtain a further increased wet-strength.

31) The method of embodiment 30 wherein the wet-strength resin is selected from the group consisting of polyaminoamido-epichlorohydrin (PAE), urea-formaldehyde (UF), melamin-formaldehyde (MF), glyoxylated polyacrylamide (g-PAM) and any combination thereof.

32) The method of embodiment 31, wherein the wet-strength resin is PAE, e.g. added in an amount of up to about 5 kg per ton pulp, of up to about 10 kg per ton pulp or of up to about 20 kg per ton pulp.

33) The method of any one of the previous embodiments which is a continuous pulping process.

34) The method of any one of the preceding embodiments comprising the steps of:

providing a pulp having a dryness of at least about 85%;

continuously adding a predetermined amount of a dicarboxylic acid anhydride to the dried pulp using a distribution medium for homogeneous distribution;

optionally maintaining the process temperature substantially constant or decreasing following the dicarboxylic acid anhydride addition;

measuring, online or intermittently, e.g. at regular or irregular time intervals, the surface charge of the pulp; and adjusting, if needed, the amount of dicarboxylic acid anhydride to be added to the pulp based on the measured surface charge, so as to achieve a desired negative surface charge of the modified pulp of at least about 8 μmol/g.

35) The method of any one of the previous embodiments further comprising the step of producing a paper product from the modified pulp.

36) The method of embodiment 35, wherein the paper product produced from the modified pulp has an increased wet strength, e.g. an increased wet tensile strength index, compared to a paper product produced from an unmodified reference pulp.

37) The method of embodiment 36 wherein the increased wet strength is observed without subsequent addition of a wet-strength resin.

38) A modified lignocellulosic pulp obtainable by a method of any one of embodiments 1-37.

39) A lignocellulosic pulp for high wet-strength applications, being modified by dicarboxylic acid anhydride addition, and characterized by a negative surface charge of at least about 8 μmol/g or at least about 10 μmol/g based on the dry pulp weight and optionally a relative negative surface charge from about 15% to about 40%.

40) The pulp of embodiment 38 or 39 being selected from the group of: a kraft pulp; e.g. a softwood kraft pulp or a eucalyptus kraft pulp; and a sulfite pulp.

41) The pulp of any one of embodiments 38-40 being a northern bleached softwood kraft (NBSK) pulp, particularly with a negative surface charge of at least about 20 μmol/g and/or a relative negative surface charge of at least about 18%.

42) The pulp of any one of embodiments 39-41, which has been subjected to beating wherein the Schopper Riegler degree of the modified pulp has been increased by at least 2° SR or by at least 3° SR.

43) The pulp of any one of embodiments 39-42, which has a Schopper Riegler degree of at least about 16° SR or of at least about 19° SR after beating.

44) A fiber-based product, particularly a paper product, obtainable from a modified lignocellulosic pulp according to any one of embodiments 39-43.

45) The product of embodiment 44 which is a tissue paper, particularly for high wet-strength applications such as household paper and hygiene paper.

46) Use of a modified lignocellulosic pulp according to any one of embodiments 38-44 for the manufacture of a fiber-based product such as a paper product, particularly for the manufacture of a wet-strength paper product including board and packaging products, more particularly for the manufacture of a tissue paper.

47) Use of dicarboxylic acid anhydride for increasing the wet-strength of lignocellulosic pulp and of a fiber-based product, particularly of a paper product from said pulp without addition of a wet-strength resin.

Further, the present invention is explained by the following Figures and Examples:

FIGURE LEGENDS

Figure 3A:
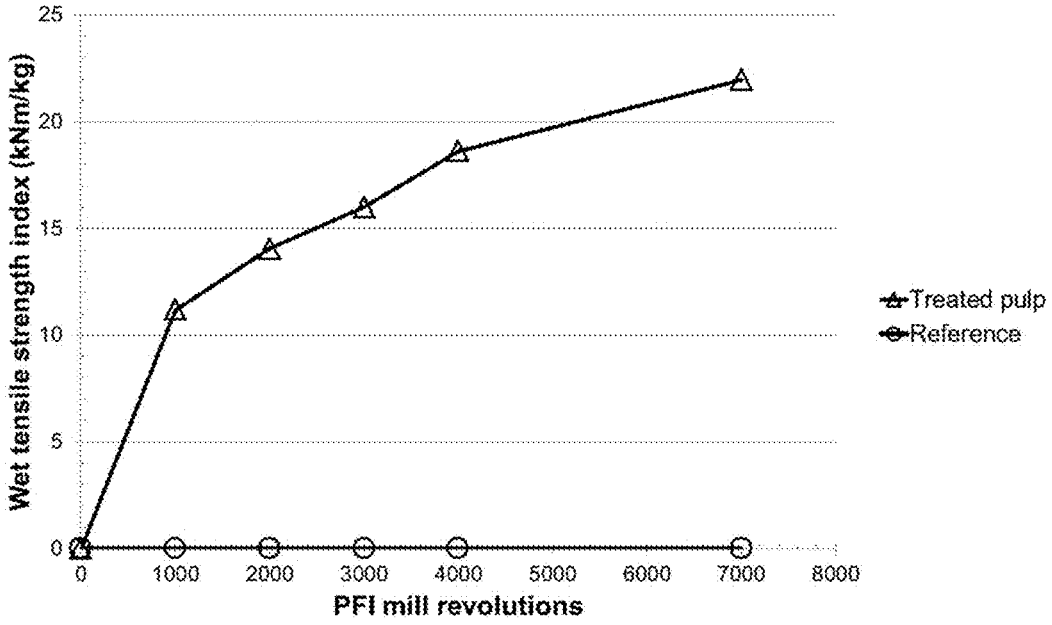

FIG. 3*a* shows the wet tensile strength of a reference pulp and a maleic acid anhydride treated pulp as a function of beating revolutions in a PFI mill.

Figure 3B:
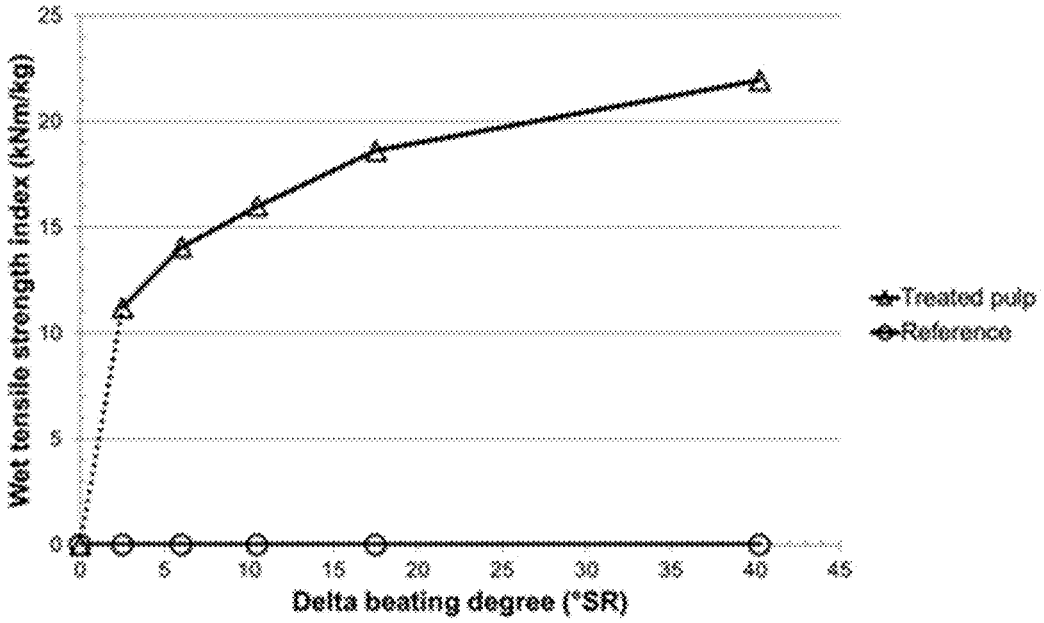

FIG. 3*b* shows the wet tensile strength of a reference pulp and a maleic acid anhydride treated pulp as a function of the delta beating degree (° SR); i.e. the difference of the beating degree after and before beating for a reference pulp and maleic acid anhydride treated pulp.

Figure 4:
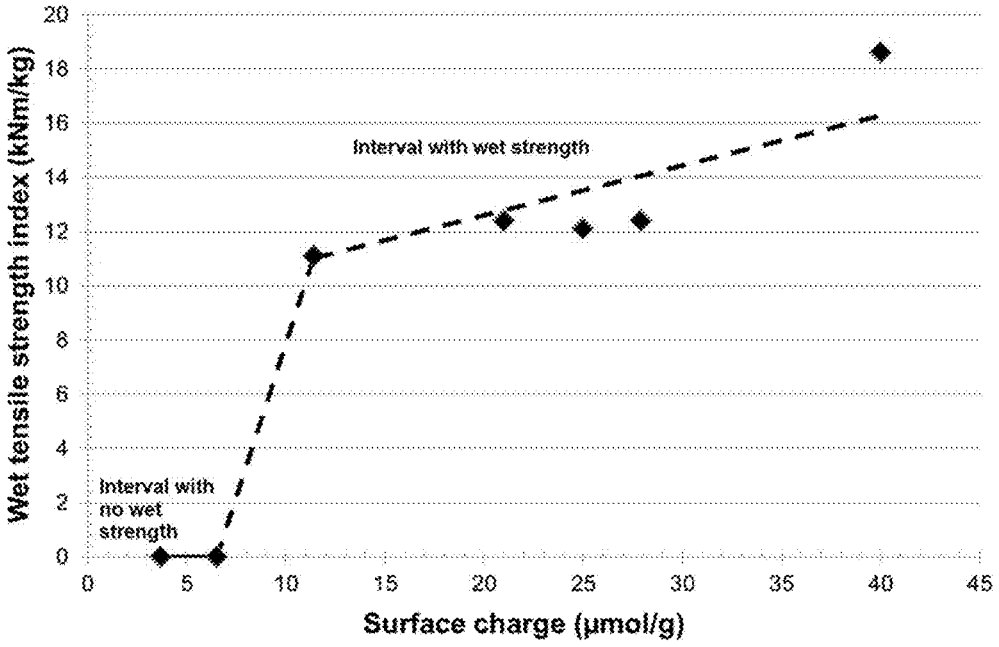

FIG. 4 schematically illustrates the surface charge and wet strength of a number of northern bleached softwood kraft (NBSK) pulps treated with maleic acid anhydride.

METHODS

1. Charge Determination

The negative surface charge and total negative charge of pulp fibers were analyzed by using polyelectrolyte adsorption, described e.g. in Winter et. al. "Polyelectrolytes Adsorbed on the Surface of Cellulosic Materials" (J. Colloid Interface Sci. 111(2), 1986, p. 537-543). To the pulp suspension a controlled amount of sodium hydrogen carbonate, $NaHCO_3$ from Merck KGaA was added to a molar concentration of 10 mM for 15 min while stirring. The addition of the buffer resulted in a pH of 8.3. The pulp fibers were then washed with deionized water for minimum three times or until the pH was 7.5 and the conductivity was below 5 μS/cm in the filtrate.

For determination of the negative surface charge of a pulp, polyelectrolyte adsorption isotherms on fibers were made using poly(diallyldimethylammonium) chloride, (polyDADMAC Alcofix 132 from Allied Colloids) ultrafiltrated using a filter with cut-off of 300000 Da in order to remove the low-molecular weight fraction.

PolyDADMAC was added to the fibers and then mixed with a magnetic stirrer for 30 min prior to filtration. The filtrate was then titrated with potassium polyvinyl sulfate (KPVS from Wako Pure Chemical Industries) using a particle charge detector, (PCD 03 equipment from BTG Mütek) in order to detect the zero point and calculate the negative fiber surface charge expressed in μmol/g.

For determination of the negative total charge of a pulp, polyelectrolyte adsorption isotherms on fibers were made using hexadimethrine bromide, (Polybrene from Sigma Aldrich) with a molecular weight of 4,000-6,000 g/mol.

Polybrene was added to the fibers and then mixed with a magnetic stirrer for 30 min prior to filtration. The filtrate was then titrated with KPVS using the particle charge detector in order to detect the zero point and to calculate the total negative fiber charge expressed in μmol/g.

2. Preparation of Paper Hand Sheets

Paper hand sheets were prepared for strength evaluation using unmodified reference pulps and pulps modified with maleic acid anhydride using different treatment protocols.

The sheets were prepared from pulp diluted with water containing $NaHCO_3$. A solution was prepared containing 1% $NaHCO_3$ and then the pH of the solution was adjusted to 7.5. The pulp was soaked in the solution for at least 4 h and thereafter disintegrated. All pulps, both modified and the reference pulps, were disintegrated in a standard laboratory disintegrator according to ISO 5263-1 operated with 30000 revolutions. Prior to sheet forming the pulps were beaten in a standard PFI mill according to ISO 5264-2. If nothing else mentioned the PFI beating was performed using 4000 revolutions.

Hand sheets with a basis weight of 65 g/m$^2$ were then prepared according to ISO 5269-1. The prepared sheets were heated at a temperature of 105° C. for 10 min before measuring the strength properties. This was made in order to simulate the drying in the paper machine.

3. Wet Strength Measurements

The wet tensile strength properties of the paper hand sheets were measured according to ISO 1924-3. Paper strips were soaked in water prior to wet tensile strength testing. The soaking time was 15 s.

The wet strength of a pulp herein refers to the wet strength of sheets prepared from the pulp according to the procedures described above, i.e. by disintegrating the pulp in a standard laboratory disintegrator according to ISO 5263-1 operated with 30000 revolutions followed by beating the pulp 4000 revolutions in a PFI mill according to ISO 5264-2, then forming a sheet according to ISO 5269-1, heating the sheet at 105° C. for 10 min and finally testing its wet strength according to ISO 1924-3.

4. Measurements of the Schopper Riegler Beating Degree

Measurements of the Schopper Riegler (SR) beating degree were carried out in accordance with ISO 5267-2.

EXAMPLES

Example 1

(Comparative Example, Prior Art)

A bleached softwood kraft pulp (NBSK) was examined with regard to its charge as described in the section "Methods". The negative surface charge was 4 μmol/g and the relative negative surface charge was 15%.

Paper hand sheets were prepared from the pulp and examined with regard to their wet strength characteristics as described in section "Methods". The wet tensile strength index was determined as being 0 kNm/kg.

This example shows that standard bleached softwood kraft pulp has a low negative surface charge and that this pulp has no wet strength.

Example 2

(Comparative Example, Prior Art)

A bleached eucalyptus kraft pulp (BEK) was examined with regard to its charge characteristics as described in the section "Methods". The negative surface charge was 3 μmol/g and the relative negative surface charge was 5%.

Paper hand sheets were prepared from the pulp and examined with regard to their wet strength characteristics as described in section "Methods". The wet tensile strength index was determined as being 0 kNm/kg.

This example shows that standard bleached eucalyptus kraft pulp has a low negative surface charge and that this pulp has no wet strength.

Example 3

Sheets of a bleached softwood kraft pulp (NBSK) were treated with maleic acid anhydride using acetone as a distribution medium. The sheets were impregnated by soaking in a solution of 5% (w/w) maleic acid anhydride, purity: 99%, (Sigma Aldrich) in acetone, pro analysi, (Honeywell Specialty Chemicals). The impregnation was accomplished by placing a sheet in the liquid for about 5 minutes and then allowing excess of liquid to drain by placing the sheet on a PE-film in horizontal position. After evaporation of the acetone at room temperature, the sheet was placed in a plastic bag, which was closed and kept in a laboratory drying oven at 70° C. for 1 h.

The treated pulp was examined with regard to its charge as described in the section "Methods". It showed a negative surface charge of 40 μmol/g and a relative negative surface charge of 28%.

Paper hand sheets were prepared from the pulp and examined with regard to their wet strength characteristics as described in section "Methods". The wet tensile strength index was determined as being 18.6 kNm/kg.

This example shows that the negative surface charge of bleached kraft fibers can be increased considerably by treatment with maleic acid anhydride accomplished by dissolving maleic acid anhydride in an aprotic solvent, adding the solution to the fibers, evaporating the solvent and keeping the fibers at a temperature above the melting point of maleic acid anhydride. This treatment results in high wet strength of paper produced from the modified pulp.

Example 4

Sheets of a bleached eucalyptus kraft pulp (BEK) were treated with maleic acid anhydride using acetone as a distribution medium. The sheets were impregnated by soaking in a solution of 5% (w/v) maleic acid anhydride, purity: 99%, (Sigma Aldrich) in acetone, pro analysi, (Honeywell Specialty Chemicals). The impregnation was accomplished by placing a sheet in the liquid for about 5 min and then allowing excess of liquid to drain by placing the sheet on a PE-film in horizontal position. After evaporation of the acetone at room temperature, the sheet was placed in a plastic bag, which was closed and kept in a laboratory drying oven at 70° C. for 1 h.

The treated pulp was examined with regard to its charge as described in the section "Methods". It showed a negative surface charge of 11 μmol/g and a relative negative surface charge of 16%.

Paper hand sheets were prepared from the pulp and examined with regard to their wet strength characteristics as described in section "Methods". The wet tensile strength index was determined as being 6.7 kNm/kg.

This example shows that the negative surface charge of bleached eucalyptus kraft fibers can be increased by treatment with maleic acid anhydride accomplished by dissolving maleic acid anhydride in an aprotic solvent, adding the solution to the fibers, evaporating the solvent and keeping the fibers at a temperature above the melting point of maleic acid anhydride. This treatment results in improved wet strength of paper produced from the modified pulp.

Example 5

Sheets of a bleached softwood kraft pulp (NBSK) were conditioned at 50% relative humidity (RH) and 23° C. The sheets were disintegrated by the aid of a Kamas H01 hammer mill equipped with a sieving plate with Ø 5 mm holes. Stripes with a length of 60 cm and a width of 5 cm were cut from the pulp sheets and then inserted into the hammer mill at a feeding rate of 2.2 m/minute. The rotor speed was 4000 rpm. Fluffed pulp consisting of substantially free fibers was prepared. The pulp was dried at 70° C. in a drying oven for 2 h.

0.8 g maleic acid anhydride, purity: 99%, (Sigma Aldrich), was placed in a steel tray. 20 g fluffed pulp was placed in another tray with a bottom made from a 4 mesh net. The two trays were then joined together and a lid, was used to enclose the pulp. As the pulp lay on a net it was not in direct contact with the maleic acid anhydride but could still be reached if the chemical was gasified.

Figure 1:
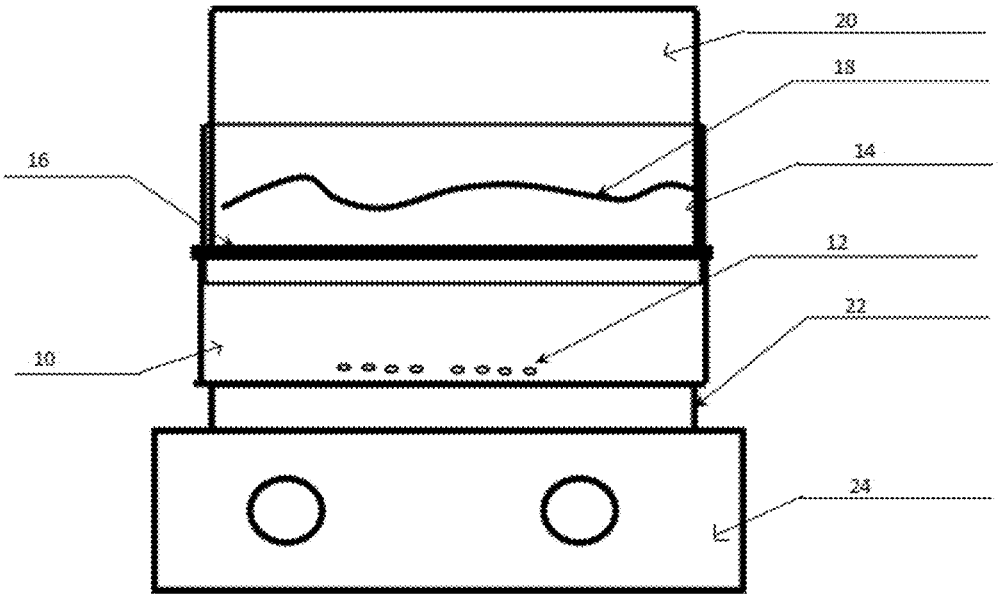
FIG. 1 shows a schematic depiction of a device for carrying out the process according to the present invention.

FIG. 1 shows a scheme of the device. The tray 10 with maleic acid anhydride 12 was positioned below the tray 14 with the net 16 and the fluffed pulp 18 closed by lid 20. The tray 10 with maleic acid anhydride 12 was placed on the hot plate 22 of a heating device 24. The temperature of the plate was 220° C., which caused evaporation of the maleic acid anhydride and treatment of the fluffed pulp by the gasified maleic acid anhydride. The fluffed pulp 18, being at a distance from the hot plate 22, had a temperature of approximately 50-60° C. After 20 h, the pulp was collected.

The treated pulp was examined with regard to its charge as described in the section "Methods". It showed a negative surface charge of 25 μmol/g and a relative negative surface charge of 20%.

Paper hand sheets were prepared from the pulp and examined with regard to their wet strength characteristics as described in section "Methods". The wet tensile strength index was determined as being 12.1 kNm/kg.

This example shows that the negative surface charge of bleached kraft fibers can be increased by treatment with gasified maleic acid anhydride and that this increase results in improved wet strength of paper produced from the pulp.

Example 6

In this example, triacetin was tested as an alternative to using acetone and similar distribution media. Triacetin is associated with a number of advantages, such as being a comparatively inexpensive, odorless, and harmless distribution medium.

Sheets of bleached softwood kraft pulp (NBSK) were treated with maleic acid anhydride using triacetin as a medium. The sheets were sprayed with a solution consisting of 50 weight-% maleic acid anhydride, (purity: 99%, Sigma Aldrich) and 50 weight % triacetin, (purity: 99%, Sigma Aldrich). The spraying was accomplished by spraying both sides of a pulp sheet by the aid of a spray bottle. About 83 g solution was added per kg pulp, which resulted in an addition of 41.5 g maleic acid anhydride/kg pulp. Several treated sheets were stacked on top of each other and pressed together. The sheets were then placed in a plastic bag and stored at 70° C. for three days.

The treated pulp was examined with regard to its charge as described in the section "Methods". It showed a negative surface charge of 21.5 μmol/g and a relative negative surface charge of 18%.

Paper hand sheets were prepared from the pulp and examined with regard to their wet strength characteristics as described in section "Methods".The wet tensile strength index was determined to 6.8 kNm/kg.

This example shows that the negative surface charge of bleached kraft fibers can be increased by spraying a pulp sheet with maleic acid anhydride dissolved in a high boiling aprotic solvent and that this treatment results in improved wet strength of paper produced by the pulp.

In this experiment, triacetin was sprayed onto the sheets with a less than optimum sheet coverage. The improved wet strength was observed even without complete immersion of pulp sheets into a liquid distribution medium. Thus, triacetin can be a useful alternative to acetone and similar distribution media in industrial processes.

Example 7

Sheets of bleached softwood kraft pulp (NBSK) were treated with maleic acid anhydride using acetone as a distribution medium. The sheets were impregnated by soaking in a solution of 2% (w/w) maleic acid anhydride, purity: 99%, (Sigma Aldrich) in acetone, pro analysi, (Honeywell Specialty Chemicals). The impregnation was accomplished by placing a sheet in the liquid for about 5 min and then allowing excess of liquid to drain by placing the sheet on a PE-film in horizontal position. After evaporation of the acetone at room temperature, the sheet was placed in a plastic bag, which was closed and kept in a laboratory drying oven at 70° C. for 1 h.

Untreated reference pulp and pulp treated with maleic acid anhydride was examined with regard to its charge and wet-strength characteristics as described in the section "Methods". The beating degree in Schopper Riegler (SR) was measured according to ISO 5267-1.

Additionally, Kymene 25 X-Cel, a polyaminoamide epichlorohydrin (PAE) from Solenis was added in this example. Sheets were prepared with additions of 5, 10 and 20 kg of PAE per ton pulp, respectively, both to treated and untreated pulp suspension. The adsorption time for PAE was 1 min prior to sheet forming. The prepared sheets were heated at 105° C. for 10 minutes before measuring the strength properties. Soaking time when measuring wet tensile strength was 15 seconds.

The treated pulp without addition of PAE showed a negative surface charge of 11.4 μmol/g. The wet tensile strength index of a hand paper sheet made from this pulp was determined to 11.1 kNm/kg.

Figure 2:
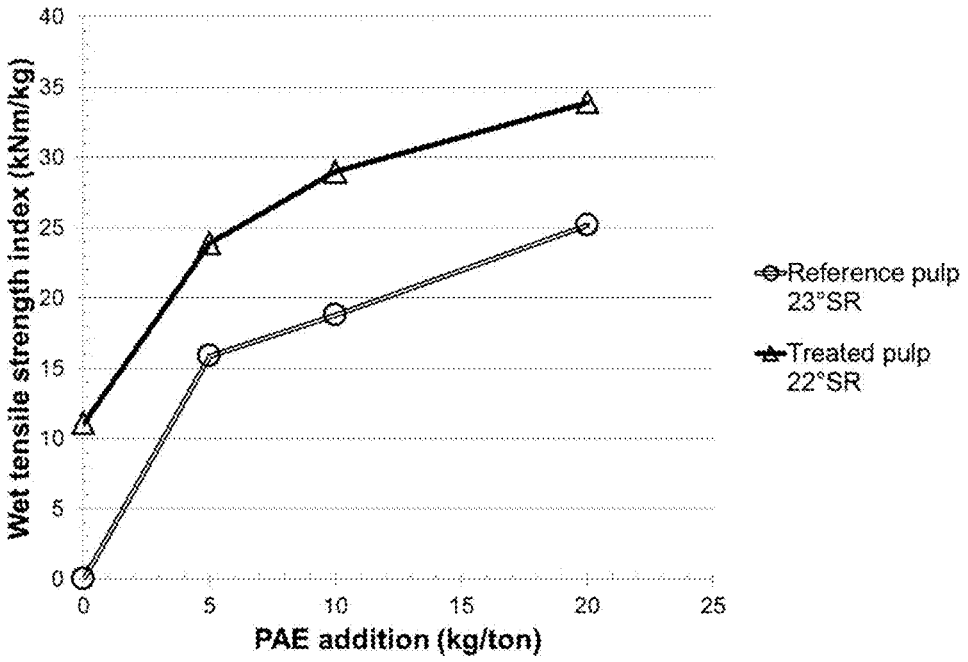
FIG. 2 shows the wet tensile strength of a reference pulp and a maleic acid anhydride treated pulp as a function of the PAE addition.

This example shows improved wet strength of paper produced from the treated pulp. As can be seen in FIG. 2 it also shows an increase in the wet tensile strength index after addition of PAE both to the reference pulp and the maleic acid anhydride treated pulp. However, the treated pulp shows a higher strength than the untreated reference pulp which indicates an additive effect of maleic acid anhydride treatment of the pulp and PAE addition during paper preparation.

Example 8

Sheets of bleached softwood kraft pulp (NBSK) were treated with maleic acid anhydride using acetone as a distribution medium. The sheets were impregnated by soaking in a solution of 5% (w/w) maleic acid anhydride, purity: 99%, (Sigma Aldrich) in acetone, pro analysi, (Honeywell Specialty Chemicals). The impregnation was accomplished by placing a sheet in the liquid for about 5 min and then allowing excess of liquid to drain by placing the sheet on a PE-film in horizontal position. After evaporation of the acetone at room temperature, the sheet was placed in a plastic bag, which was closed and kept in a laboratory drying oven at 70° C. for 1 h.

The treated pulp was examined with regard to its charge as described in the section "Methods". It showed a negative surface charge of 40 μmol/g and a relative negative surface charge of 28%.

Paper hand sheets were prepared from the pulp and examined with regard to their wet strength characteristics as described in section "Methods". The wet tensile strength index was determined as being 18.6 kNm/kg.

In order to evaluate the influence of beating, the procedure described in the section "Methods" was modified by using several different numbers of revolutions when beating the pulp in a PFI mill. The pulp was beaten 0, 1000, 2000, 3000, 4000 and 7000 revolutions in the PFI mill. The results are shown in FIG. 3*a*. The wet tensile strength characteristics as a function of the delta beating degree (° SR) are shown in FIG. 3*b*.

This example, with unbeaten and PFI beaten pulp, respectively, shows that some beating is needed to achieve a wet strong paper and that in the investigated range of beating degree the wet tensile strength index can be further increased by increasing the beating degree.

Example 9

A number of bleached softwood kraft pulps, more particularly northern bleached softwood kraft (NBSK) pulps, were treated with maleic acid anhydride. The treatment with maleic acid anhydride involved soaking of sheets with acetone as distribution media, as described above in Example 3, and treatment of fluffed pulp with gasified maleic acid anhydride, as described above in Example 5. The dryness of the pulps was about 90 weight-% or higher during treatment.

Surface charge and wet strength of the respective pulps were determined as described in section "Methods".

FIG. 4 schematically illustrates the relation between wet strength and negative surface charge for these maleic acid anhydride treated NBSK pulps. An unmodified reference NBSK pulp is also included in FIG. 4, i.e. the point with surface charge 4 μmol/g and no wet strength (cf. Example 1).

This example indicates that a considerable improvement of the wet strength of the pulp can be achieved by pulp treatment with maleic acid anhydride in accordance with the present invention. An interval with no wet strength at low surface charges is followed by an interval with high, increasing wet strength, as illustrated by the approximate dashed line in FIG. 4.

The invention claimed is:

1. A method for producing a modified lignocellulosic pulp, comprising the steps:

(i) providing a dry lignocellulosic pulp, particularly a pulp having a dryness of at least about 85 weight-%;

(ii) adding a dicarboxylic acid anhydride with a molecular weight of 220 g/mol or less to the dry pulp in an amount and under conditions to obtain a modified pulp having a negative surface charge of at least about 8 μmol/g based on the dry pulp weight; and (iii) beating the pulp from step (ii).

2. The method of claim 1, wherein in step (iii) the Schopper Riegler degree of the pulp is increased by at least 2° SR.

3. The method of claim 2, wherein in step (iii) the Schopper Riegler degree of the pulp is increased by up to 70° SR.

4. The method of claim 1, wherein the pulp has a Schopper Riegler degree of at least about 16° SR after step (iii).

5. The method claim 1, wherein the modified pulp has increased wet-strength, compared to an unmodified reference pulp, particularly an increased wet tensile strength index, e.g. a wet tensile strength index of at least 5 kNm/kg after beating when measured according to ISO 1924-3.

6. The method of claim 1, wherein the dicarboxylic acid anhydride is added in an amount of between about 1 kg to about 55 kg per ton pulp based on the dry pulp weight.

7. The method of claim 1, wherein a modified pulp having a relative negative surface charge from about 15% to about 40 is obtained.

8. The method of claim 1, wherein said pulp is an unbeaten pulp, particularly selected from a kraft pulp, or a sulfite pulp, particularly selected from a softwood pulp, or a hardwood pulp, particularly a northern bleached softwood kraft (NBSK) pulp or a eucalyptus kraft pulp, particularly an NBSK pulp.

9. The method of claim 1, wherein the dicarboxylic acid anhydride is maleic acid anhydride.

10. The method of claim 1, wherein the pulp is kept at a temperature of about 100° C. or less during the time period where a reaction between the pulp and the dicarboxylic acid anhydride takes place.

11. The method of claim 1, wherein the dicarboxylic acid anhydride is added to the pulp in a gaseous or liquid distribution medium, in which the dicarboxylic acid anhydride is homogenously distributed.

12. The method of claim 11, wherein the distribution medium is a gaseous distribution medium comprising the dicarboxylic acid anhydride in gaseous form, and wherein the pulp is provided as disintegrated pulp, e.g. as fluffed pulp and/or flash-dried pulp.

13. The method of claim 11, wherein the distribution medium is a liquid distribution medium, particularly an aprotic organic solvent with a boiling point of at least about 80° C. under atmospheric pressure comprising the dicarboxylic acid anhydride in dissolved form, and wherein the pulp is provided in form of a sheet.

14. The method of claim 1 further comprising the step of producing a fiber-based product from the modified pulp.

15. The method of claim 14, wherein a paper product produced from the modified pulp has an increased wet strength compared to a paper product produced from unmodified pulp reference, wherein the increased wet strength is observed without subsequent addition of a wet-strength resin.

* * * * *